US009936782B2

(12) United States Patent
Puopolo

(10) Patent No.: US 9,936,782 B2
(45) Date of Patent: Apr. 10, 2018

(54) ATTACHABLE ORGANIZER-CADDY APPARATUS, SYSTEM, KIT, AND METHODS

(71) Applicant: Vito Puopolo, Los Osos, CA (US)

(72) Inventor: Vito Puopolo, Los Osos, CA (US)

( * ) Notice: Subject to any disclaimer, the term of this patent is extended or adjusted under 35 U.S.C. 154(b) by 0 days.

(21) Appl. No.: 14/511,081

(22) Filed: Oct. 9, 2014

(65) Prior Publication Data

US 2016/0100660 A1 Apr. 14, 2016
US 2016/0295984 A9 Oct. 13, 2016

Related U.S. Application Data

(60) Provisional application No. 61/889,380, filed on Oct. 10, 2013.

(51) Int. Cl.
*A45C 13/02* (2006.01)
*A45C 13/00* (2006.01)
*A45C 11/24* (2006.01)

(52) U.S. Cl.
CPC ..... *A45C 13/001* (2013.01); *A45C 11/24* (2013.01); *A45C 13/02* (2013.01)

(58) Field of Classification Search
CPC .... A45C 13/001; A47G 25/0614; A47B 43/04
USPC ..... 220/503, 528; 206/232; 211/119.004, 211/85.2
See application file for complete search history.

(56) References Cited

U.S. PATENT DOCUMENTS 3,580,471 A * 5/1971 Burke ..... B65D 5/48026 217/30
4,736,853 A 4/1988 O'Mara
5,178,295 A * 1/1993 Crumrine ..... B65D 25/04 206/470
5,339,547 A 8/1994 Fogel
5,351,813 A 10/1994 Golovan
7,063,397 B2 * 6/2006 Sabounjian ..... A47B 43/003 206/287.1
D566,986 S * 4/2008 Greiner ..... D6/514
8,047,374 B1 * 11/2011 Heinzler ..... A61J 7/0069 206/538
2006/0171045 A1 * 8/2006 Carnevali ..... G02B 27/027 359/802

(Continued)

*Primary Examiner* — Stephen Castellano
(74) *Attorney, Agent, or Firm* — Gina M. Lupino

(57) ABSTRACT

An attachable organizer-caddy system, the system involving: a first planar sheet having a front surface and a rear surface; a second planar sheet having a front surface and a rear surface; and a third planar sheet having a front surface and a rear surface, the second planar sheet rear surface capable of coupling with the first planar sheet front surface by way of at least one of at least one coupling strip and at least one partition, whereby at least one primary compartment is provided therebetween for facilitating disposition of at least one informational item and at least one related item, and the third planar sheet rear surface capable of coupling with the second planar sheet front surface by way of at least one of the at least one coupling strip and the at least one partition, whereby at least one secondary compartment is provided therebetween for facilitating disposition of at least one informational item and at least one related item. The system further includes an auxiliary accessory holder for use in a vehicle, such as an automobile.

8 Claims, 7 Drawing Sheets

(56) References Cited

U.S. PATENT DOCUMENTS

| | | | | |
|---|---|---|---|---|
| 2011/0315707 | A1* | 12/2011 | Kleinhuber | A47K 10/421<br>221/155 |
| 2012/0091018 | A1* | 4/2012 | Bock | B42F 7/065<br>206/307 |
| 2014/0144952 | A1* | 5/2014 | Prado | A47G 25/18<br>223/120 |
| 2015/0133029 | A1* | 5/2015 | Casey-Mederios | A47G 25/18<br>450/52 |
| 2015/0349504 | A1* | 12/2015 | Allison | H02G 3/081<br>174/66 |

* cited by examiner

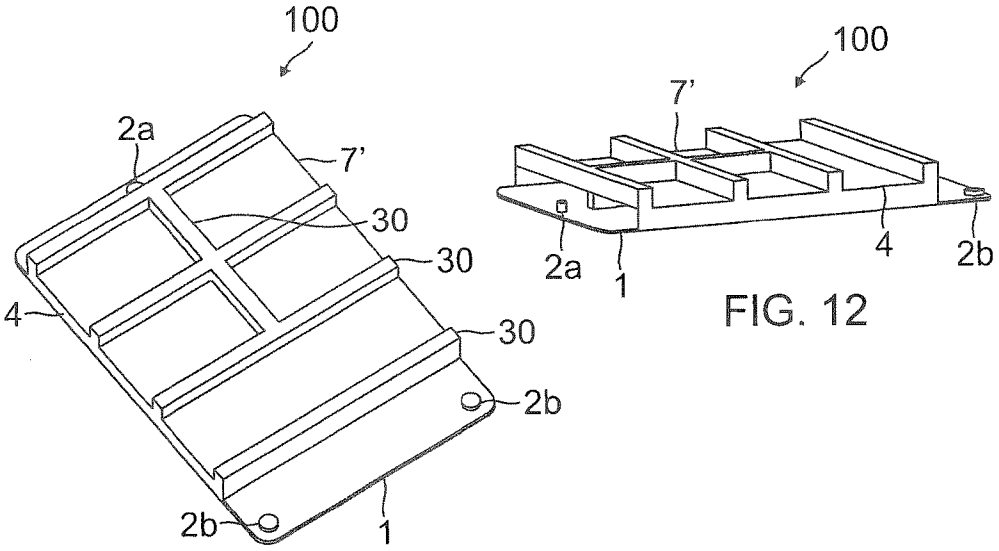
FIG. 10
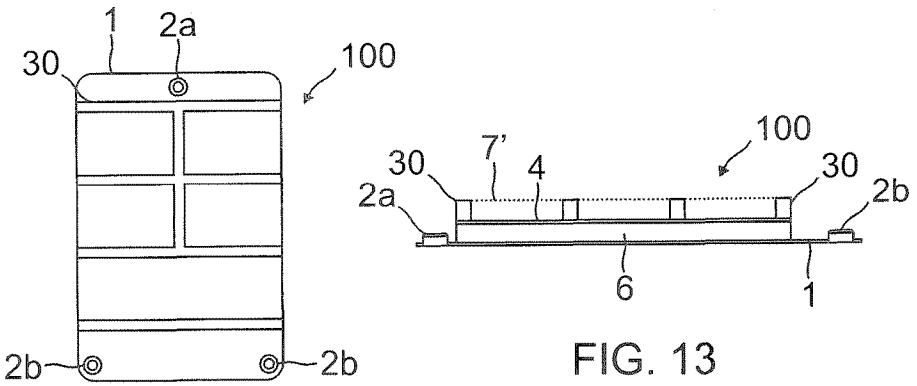
FIG. 11
FIG. 12
FIG. 13
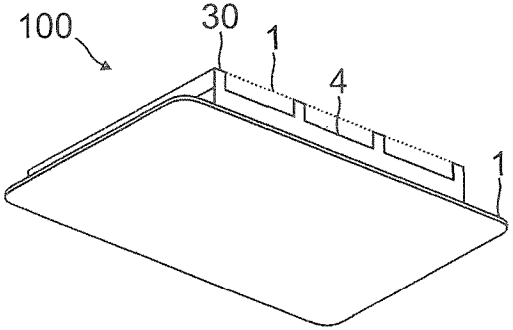
FIG. 14
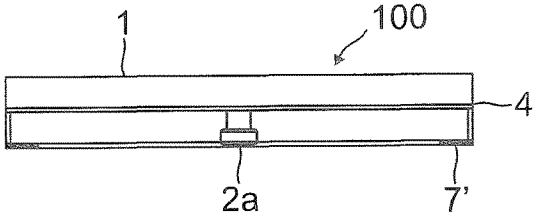
FIG. 15

ATTACHABLE ORGANIZER-CADDY APPARATUS, SYSTEM, KIT, AND METHODS

CROSS-REFERENCE TO RELATED APPLICATION

The document is a non-provisional patent application claiming the benefit of, and priority to, U.S. Provisional Patent Application Ser. No. 61/889,380, filed on Oct. 10, 2013, also entitled "ATTACHABLE ORGANIZER-CADDY APPARATUS, SYSTEM, KIT, AND METHODS," which is hereby incorporated by reference in its entirety for all purposes.

TECHNICAL FIELD

The present disclosure technically relates to the field of organizers and displays of appointment reminders. More particularly, the present disclosure technically relates to the field of organizers and displays of appointment reminders for providing convenient storage, display, and access to a variety of informational items and related items.

BACKGROUND

For most people, seniors in particular, medical service is typically provided by a primary physician, at least one specialist, and a dentist. For future appointments, patients are given appointment cards and, as needed, laboratory order sheets, such as for blood work, e.g., a "blood lab order sheet," several weeks or even months in advance of the appointment. Over time, patients, such as seniors, may often misplace, lose track of, or even accidentally discard these appointment cards and laboratory order sheets. Although many health service providers, such as medical and dental offices, typically telephone the patient with a reminder one day prior to the scheduled appointment, this reminder telephone call typically occurs after the patient has already consumed breakfast, i.e., at a time which is too late to engage in the requisite fasting prior to performing a blood test. Further, if a blood lab order sheet is lost, the appointment must be rescheduled; and a new blood lab order sheet issued to the patient. Additionally, other items that arc also often misplaced, in a senior lifestyle, are sunglasses, prescription eyeglasses, reading glasses, keys, and the like. In an attempt to address some senior concerns, the related art includes a number of organizers having a card display and a variety of object-holding devices that are mounted on a vertical surface.

For instance, U.S. Pat. No. 5,339,547 to Fogel involves a display device that includes a solid member having predetermined dimensions and at least one planar upper surface. The planar surface has a plurality of slots extending fully across the planar surface. The slots have a width and depth suitable for holding a substantially self-supporting flat object at a substantially vertical orientation. The Fogel device also includes a support for elevating the planar surface at an incline, preferably from 5° to 30° from the horizontal plane. A plurality of these display devices can be connected to each other or juxtaposed, in modular fashion, along their sides or portions thereof. The Fogel device displays photographs and a variety of cards that tire placed into slots in a base which inclines such that each row is higher than the adjacent row. However, cards and photography must be manually removed from the Fogel device in order to be completely read or completely viewed. In addition, the plurality of rows of cards or photographs creates undue bulkiness in the Fogel device.

In addition, U.S. Pat. No. 5,351,813 to Golovan involves an apparatus for holding relatively small items having a generally flexible planar base, an attachment structure for attaching the base to a vertical surface, such as a refrigerator door or the like, at least one storage and/or display compartment, and at least one fastener for releasably attaching the compartments to the base. The Golovan apparatus allows a user to detach and carry along the detachable compartment to a desired destination. In addition, the Golovan apparatus may be utilized for organizing and/or visibly displaying relatively lightweight and thin materials, such as cards, theatrical tickets, photographs, sketches, etc., without puncturing or adversely affecting the integrity of the material. The Golovan apparatus has a transparent flexible planar base with a magnetic element for attachment to a vertical surface with a corresponding magnetic element. The base is a transparent, flexible sheet to which compartments for holding cards of varying types and sizes are attached and detached by way of snap fasteners. However, reading information on the cards at a comfortable distance may be difficult for many users, such as seniors, thereby necessitating manual removal of the cards from the Golovan apparatus in order to see them. To insert or remove cards, individual holding compartments must be manually detached. Further, the base is attachable to magnetic surfaces only which limits the use of the Golovan apparatus.

Also, U.S. Pat. No. 4,736,853 to O'Mara involves a flexible magnetized holder with pockets for accessories, such as pens, tissues, or the like, which allows for convenient placement on, and removal from, ferromagnetic surfaces, such as locker doors and refrigerator doors. The O'Mara holder includes a flexible fabric material, a flexible sheet, of non-ferrous material having permanently magnetized particles dispersed throughout the sheet, and a structure for mounting the fabric material to the magnetic sheet for forming a pocket. In particular, the O'Mara holder is a pen and pencil accessory holder having a planar base to which a flexible, envelope-like device is magnetically attached. The envelope-like device of the O'Mara holder is divided into pockets into which objects are inserted from the top of each pocket. However, the function of this envelope-like device of the O'Mara holder is limited primarily to storage; and the envelope-like device of the O'Mara holder does not have a readable display.

While these related art apparatuses involve a card display and a variety of object-holding features that are intended for connection to a vertical surface, these related art apparatuses are limited in their functionality and fail to address most senior concerns.

BRIEF SUMMARY

In addressing the problems experienced in the related art, especially for seniors, the present disclosure describes an attachable organizer-caddy apparatus, system, kit, and related methods for organizing, storing, displaying, and facilitating access to, a plurality of informational items, such as medical appointment reminder cards, medical insurance coupon payment hooks, blood test laboratory order sheets, as well as related items, such as commonly misplaced objects, e.g., eyewear (prescription eyeglasses, sunglasses, prescription sunglasses, reading glasses, and the like), keys, key fobs, electronic key fobs, and card keys.

To this end, in an embodiment of the present invention, an attachable organizer-caddy system comprises: a first planar sheet having a front surface and a rear surface; a second planar sheet having a front surface and a rear surface; and a third planar sheet having a front surface and a rear surface, the second planar sheet rear surface capable of coupling with the first planar sheet front surface by way of walls forming at least one primary compartment therebetween for facilitating disposition of at least one informational item and at least one related item, and the third planar sheet rear surface capable of coupling with the second planar sheet front surface by way of walls forming at least one secondary compartment therebetween for facilitating disposition of at least one informational item and at least one related item into and out of the organizer-caddy system.

In another exemplary embodiment of the attachable organizer-caddy system, at least one wall comprises at least one of a double-stick feature and a permanent adhesive; and a wall configured to couple with at least one of the first planar sheet, the second planar sheet, and the third planar sheet by way of at least one of molding, heating, pressing, vacuum molding, and injection molding.

In another exemplary embodiment of the attachable organizer-caddy system, the first and second planar sheets comprise at least one of a rigid material, a flexible material, and a semi -rigid material.

In another exemplary embodiment of the attachable organizer-caddy system, the first planar sheet comprises at least one of; at least one primary magnet capable of coupling with a magnetic surface; at least one adhesive strip capable of coupling with a non-magnetic surface; and a hook is horizontally disposed in relation to a lower portion of the first planar sheet for slidably accommodating hangable objects.

In another exemplary embodiment of the attachable organizer-caddy system, the at least one primary magnet is embeddable in the first planar sheet.

In another exemplary embodiment of the attachable organizer-caddy system, the at least one secondary compartment comprises; an opening for facilitating insertion and removal of the at least one informational item and the at least one related item; a window having at least one of an optically transparent material and an optically translucent material; and an optional magnifying feature for facilitating at least one of viewing and reading the at least one informational item and the at least one related item, the magnifying feature capable of coupling with the window.

In another exemplary embodiment of the attachable organizer-caddy system, the optional magnifying feature comprises at least one of removability and customizability in relation to a user's optometric needs.

In another exemplary embodiment of the attachable organizer-caddy system, the wall has a thickness, lateral portions, and at least one depression disposed in relation to the lateral portions and corresponding to each at least one secondary compartment for facilitating manual disposition of the at least one informational item and the at least one related item.

In another exemplary embodiment, the attachable organizer-caddy system further comprises at least one secondary magnet disposable in relation to the first planar sheet front surface for facilitating quick detachable coupling of at least one of a magnetic item and a magnetically adaptable item.

In another exemplary embodiment of the attachable organizer-caddy system, the at least one secondary magnet is embeddable in relation to the first planar sheet front surface.

In another exemplary embodiment, the attachable organizer-caddy system further comprises at least one tertiary magnet for magnetically adapting a nonmagnetic item.

In another exemplary embodiment the attachable organizer-caddy system further comprises at least one of an attachable mounting device for facilitating in-vehicle operation, at least one quaternary magnet disposed relation to the attachable mounting device, at least one indicia element for labeling at least one of the least one primary compartment and the at least one secondary compartment, and a set of instructions for using the system.

In another exemplary embodiment, the attachable organizer-caddy system further comprises: at least one secondary magnet disposable in relation to the first planar sheet from surface for facilitating quick detachable coupling of at least one of a magnetic item and a magnetically adapted item; at least one tertiary magnet for magnetically adapting a non-magnetic item; and an attachable mounting device, comprising at least one quaternary magnet, for facilitating in-vehicle operation, wherein the wall has at least one of a double-stick feature and a permanent adhesive, wherein the first and second planar sheets comprise at least one of a rigid material, a flexible material, and a semi-rigid material, wherein the first planar sheet comprises at least one of at least one primary magnet capable of coupling with a magnetic surface and at least one adhesive strip capable of coupling with a non-magnetic surface, wherein the at least one primary magnet is embeddable in the first planar sheet, the at least one secondary compartment comprising: an opening for facilitating insertion and removal of the at least one informational item and the at least one related item, and a window having at least one of an optically transparent material and an optically translucent material, the window further comprising at least one of a polarizing filter material, a photochromic material, and a progressive lens material, and an optional magnifying feature for facilitating at least one of viewing and reading the at least one informational item and the at least one related item, the magnifying feature capable of coupling with the window, wherein the optional magnifying feature comprises at least one of removability and customizability in relation to a user's optometric needs, wherein the wall has a thickness, lateral portions, and at least one depression disposed in relation to the lateral portions and corresponding to each at least one secondary compartment, for facilitating manual disposition of the at least one informational item and the at least one related item, and wherein the at least one secondary magnet Is embeddable in relation to the first planar sheet front surface.

In an exemplary embodiment, a method of fabricating an attachable organizer-caddy system comprises: providing a first planar sheet having a front surface and a rear surface; providing a second planar sheet having a front surface and a rear surface; and providing a third planar sheet having a front surface and a rear surface; coupling the second planar sheet rear surface with the first planar sheet front surface by way of wills forming at least one primary compartment therebetween for facilitating disposition of at least one informational item and at least one related item, and coupling the third planar sheet rear surface with the second planar sheet front surface by way of walls forming at least one secondary compartment therebetween for facilitating disposition of at least one informational item and at least one related item.

In another exemplary embodiment of the fabricating method for an attachable organizer -caddy system, the wall has at least one of a double-stick feature and a permanent adhesive; and the wall is configured to couple with at least one of the first planar sheet, the second planar sheet, and the third planae sheet by way of at least one of molding, heating, pressing, vacuum molding, and injection molding.

In another exemplary embodiment of the fabricating method for an attachable organizer -caddy system, providing the first and second planar sheets comprises providing at least one of a rigid material, a flexible material, and a semi-rigid material.

In another exemplary embodiment of the fabricating method for an attachable organizer -caddy system, providing the first planar sheet comprises providing at least one of: at least one primary magnet capable of coupling with a magnetic surface; at least one adhesive strip capable of coupling with a non-magnetic surface; and a hook horizontally disposes in relation to a lower portion of the first planar sheet for slidably accommodating hangable objects.

In another exemplary embodiment of the fabricating method for an attachable organizer -caddy system, providing the first planar sheet comprises embedding the at least one primary magnet in the first planar sheet.

In another exemplary embodiment of the fabricating method for an attachable organizer -caddy system, providing the second planar .sheet further comprises providing at least one secondary compartment disposed in relation to the second planar sheet front surface, the at least one secondary compartment comprising at least one size corresponding to, and facilitating display of, at least one informational item and at least one related item, providing the at least one secondary compartment comprising providing: an opening for facilitating insertion and removal of the at least one informational item and the at least one related item; a window having at least one of an optically transparent material and an optically translucent material; and an optional magnifying feature for facilitating at least one of viewing and reading of the at least one informational item and the at least one related item, providing the magnifying feature comprising providing the magnifying feature as capable of coupling with the window.

In another exemplary embodiment of the fabricating method for an attachable organizer -caddy system, providing the optional magnifying feature comprises providing the optional magnifying feature as being at least one of removable and customizable in relation to a user's optometric needs.

In another exemplary embodiment of the fabricating method for an attachable organizer -caddy system, the wall has a thickness, lateral portions, and disposing at least one depression in relation to the lateral portions and corresponding to each at least one secondary compartment for facilitating manual disposition of the at least one informational item and the at least one related item.

In another exemplary embodiment, the fabricating method for an attachable organizer -caddy system further comprises providing at least one secondary magnet disposable in relation to the first planar sheet front surface for facilitating quick detachable coupling of at least one of a magnetic item and a magnetically adaptable item.

In another exemplary embodiment of the fabricating method for an attachable organizer -caddy system, the at least one secondary magnet is embeddable in relation to the first planar sheet front surface.

In another exemplary embodiment, the fabricating method for an attachable organizer -caddy system further comprises at least one tertiary magnet for magnetically adapting a nonmagnetic item, In another exemplary embodiment, the fabricating method for an attachable organizer -caddy system further comprises an attachable mounting device for facilitating in-vehicle operation.

In an exemplary embodiment, a method of organizing by way of an attachable caddy system comprises: providing the caddy system discussed above with a first planar sheet having a front surface and a rear surface; a second planar sheet having a front surface and a rear surface; and a third planar sheet having a front surface and a rear surface; coupling the second planar sheet rear surface with the first planar sheet front surface by way of walls forming at least one primary compartment therebetween for facilitating disposition of at least one informational item and at least one related item, and coupling the third planar sheet rear surface with the second planar sheet front surface by way of walls forming at least one secondary compartment is provided therebetween for facilitating disposition of at least one informational item and at least one related item; disposing an indicia element proximal to at least one of the at least one primary compartment and the at least one secondary compartment; disposing the at least one informational item and the at least one related item in at least one of the at least one primary compartment and the at least one secondary compartment; disposing the caddy system in relation to an object surface; and performing at least one of viewing, reading, and accessing at least one of the at least one informational item and the at least one related item.

In another exemplary embodiment, the method of organizing by way of an attachable caddy system comprises further comprises: providing an attachable mounting device for facilitating in-vehicle operation; and attaching the mounting device to the object surface, wherein the system providing further comprises providing at least one magnet for at least one of coupling the apparatus to the object surface, facilitating quick detachable coupling of at least one of a magnetic item and a magnetically adaptable item, magnetically adapting a nonmagnetic item, and detachably coupling the apparatus with the attachable mounting device.

An attachable organizer-caddy apparatus generally comprises: a first planar sheet having a front surface and a rear surface; and a second planar sheet having a front surface and a rear surface, the second planar sheet rear surface capable of coupling with the first planar sheet front surface by way of walls with an adhesive feature, such as a double-stick feature and a permanent adhesive, and forming at least one primary compartment therebetween for facilitating disposition of at least one informational item, such as at least one blood lab order sheet, and at least one related item, such as at least one coupon envelope, in accordance with the present disclosure. The first and second planar sheets further comprise at least one material, such as a rigid material, a flexible material, and a semi-rigid material. The first planar sheet further comprises at least one of at least one primary magnet capable of coupling with a magnetic surface, such as a steel refrigerator door, and at least one adhesive strip capable of coupling with a non-magnetic or low-magnetic surface, such as a cabinet door, an austenitic stainless steel refrigerator door, a bulletin board, and the like. The at least one primary magnet is embeddable in the first planar sheet. The at least one adhesive strip is disposable in relation to the first planar sheet rear surface.

The second planar sheet further comprises at least one secondary compartment disposed in relation to the second planar sheet front surface, the at least one secondary compartment comprising at least one size corresponding to, and facilitating display of, at least one informational item, such as at least one appointment card, and at least one related item, such as at least one coupon payment book. The at least one secondary compartment comprises an opening for facilitating insertion and removal of the at least one informational item and the at least one related item; and the at least one secondary compartment comprises at least one of an optically transparent material and an optically translucent material.

The at least one secondary compartment further comprises a window having an optional magnifying feature for facilitating viewing and/or reading easy reading of the at least one informational item and the at least one related item, e.g., without the use of prescription eyeglasses or reading glasses. The optional magnifying feature is further removable and/or customizable in relation to the optometric needs of a user. The walls have a thickness, lateral portions, and at least one depression disposed in relation to the lateral portions and corresponding to each at least one secondary compartment for facilitating manual disposition, e.g., insertion and removal, of the at least one informational item and the at least one related item.

An attachable organizer-caddy system generally comprises: a first planar sheet having a front surface, a rear surface, and an area; a second planar sheet having a front surface, a rear surface, and an area, the second planar sheet area being less than the first planar sheet area, the second planar sheet rear surface capable of coupling with the first planar sheet front surface by way of at least one wall with an adhesive feature, such as a double-stick feature and a permanent adhesive, and forming at least one primary compartment therebetween for facilitating disposition of informational items, such as at least one blood fab order sheet, and related items, at least one coupon envelope; and at least one secondary magnet in relation to the first planar sheet front surface, such as by embedding therein or thereon, for facilitating quick detachable coupling of magnetic and magnetically adaptable items, such as a commonly misplaced item, in accordance with the present disclosure.

An attachable organizer-caddy kit generally comprises: a first planar sheet having a front surface, a rear surface, and an area; a second rigid planar sheet having a front surface, a rear surface, and an area, the second planar sheet area being less than the first planar sheet area, the second planar sheet rear surface capable of coupling with the first planar sheet front surface by way of at least one wall with an adhesive feature, such as a double-stick feature and a permanent adhesive, and forming at least one primary compartment therebetween for facilitating disposition of at least one informational item, such as at least one blood lab order sheet, and at least one related item, such as at least one coupon envelope; at least one secondary magnet disposed in relation to the first planar sheet front surface, such as by embedding therein or thereon, for facilitating quick detachable coupling of magnetic and magnetically adaptable items, such as at least one commonly misplaced item; at least one teliiary magnet for magnetically adapting a non-magnetic commonly misplaced item; and an attachable mounting device, having at least one quaternary magnet, for facilitating in-vehicle operation, in accordance with tile present disclosure.

Alternatively, an attachable organizer-caddy system, the system generally comprises: a first planar sheet having a front surface and a rear surface; a second planar sheet having a front surface and a rear surface; and a third planar sheet having a front surface and a rear surface, the second planar sheet rear surface capable of coupling with the first planar sheet from surface by way of walls forming at least one primary compartment therebetween for facilitating disposition of at least one informational item and at least one related item, and the third planar sheet rear surface capable of coupling with the second planar sheet front surface by way of walls forming at least one secondary compartment therebetween for facilitating disposition of at least one informational item and at least one related item.

A method of fabricating an attachable organizer-caddy apparatus generally comprises; providing a first planar sheet having a front surface and a rear surface; and providing a second planar sheet having a front surface and a rear surface, coupling the second planar sheet rear surface with the first planar sheet front surface by way of walls with an adhesive feature, such as a double-stick feature, thereby providing at least one primary compartment therebetween for facilitating disposition of at least one informational item, such as at least one blood lab order sheet, and at least one related item such as at least one coupon envelope, in accordance with the present disclosure. The first and second planar sheets providing further comprise providing at least one material, such as a rigid material, a flexible material, and a semi-rigid material. The first planar sheet providing further comprises providing at least one of at least one primary magnet capable of coupling with a magnetic surface, such as a steel refrigerator door, and at least one adhesive strip capable of coupling with a non-magnetic or low -magnetic surface, such as a cabinet door, an austenitic stainless steel refrigerator door, a bulletin board, and the like. The at least one primary magnet providing comprises em bedding the at least one primary magnet in the first planar sheet. The at least one adhesive strip providing comprises disposing the at least one adhesive strip in relation to the first planar sheet rear surface.

The second planar sheer providing further comprises providing at least one secondary compartment disposed in relation to the second planar sheet front surface, the at least one secondary compartment providing comprises providing at least one size corresponding to, and facilitating display of, at least one informational item and at least one related item, such as at least one appointment card and at least one coupon payment book. The at least one secondary compartment providing comprises providing an opening for facilitating insertion and removal of the at least one informational item and the at least one related item; and the at least one secondary compartment providing comprises providing at least one of an optically transparent material and an optically translucent material.

The at least one secondary compartment providing comprises providing a window having a magnifying feature for facilitating viewing and/or reading easy reading of the at least one informational item and the at least one related item, e.g., without the use of prescription eyeglasses, reading glasses, or hand-held magnifiers. The window providing comprises further providing the magnifying feature as being customizable to the optometric needs of a user. With respect to a kit of the present disclosure, the kit may include a plurality of magnifying elements comprising the magnifying feature, wherein each of the plurality of magnifying elements comprises a distinct magnification from another magnifying element.

A method of fabricating an attachable organizer-caddy system generally comprises: providing a first planar sheet having a front surface, a rear surface, and an area; providing a second planar sheet having a front surface, a rear surface, and an area, the second planar sheet area being less than the first planar sheet area, coupling the second planar sheet rear surface with the first planar sheet front surface by way of walls with an. adhesive feature, such as a double-stick feature and a permanent adhesive, and forming at least one primary compartment therebetween for facilitating disposition of at least one informational items, such as at least, one blood lab order sheet, and at least one related item, such as at least one coupon envelope; and providing at least one secondary magnet in relation to the first planar sheet front surface, the at least one secondary magnet providing comprising embedding the at least one secondary magnet therein or thereon, for facilitating quick detachable coupling of magnetic and magnetically adaptable item, such as a commonly misplaced item, in accordance with the present disclosure.

A method of fabricating an attachable organizer-caddy kit generally comprises: providing a first planar sheet having a front surface, a rear surface, and an area; providing a second planar sheet having a front surface, a rear surface, and an area, the second planar sheet area being less than the first planar sheet area, coupling the second planar sheet rear surf ace with the first planar sheet front surface by way of walls with an adhesive feature, such as a double-stick feature and a permanent adhesive, and forming at least one primary compartment therebetween for facilitating disposition of at least one informational item, such as at least one blood lab order sheet, and at least one related item, such as at least one coupon envelope; providing at least one secondary magnet in relation to the first planar sheet front surface, the at least one secondary magnet providing comprising embedding the at least one secondary magnet therein or thereon, for facilitating quick detachable coupling of magnetic and magnetically adaptable items; and providing an attachable mounting device, having at least one quaternary magnet, for facilitating in-vehicle operation, in accordance with the present disclosure.

Alternatively, a method of fabricating an attachable organizer-caddy system, the method generally comprises: providing a first planar sheet having a front surface and a rear surface; providing a second planar sheet having a front surface and a rear surface; and providing a third planar sheet having a front surface and a rear surface; coupling the second planar sheet rear surface with the first planar sheet front surface by way of walls forming at least one primary compartment therebetween for facilitating disposition of at least one informational item and at least one related item, and coupling the third planar sheet rear surface with the second planar sheet front surface by way of walls forming at least one secondary compartment therebetween for facilitating disposition of at least one informational item and at least one related item.

A method of organizing by way of an attachable caddy system, the method generally comprises: providing the caddy system, the caddy system providing comprising: providing a first planar sheet having a front surface and a rear surface; providing a second planar sheet having a front surface and a rear surface; and providing a third planar sheet having a from surface and a rear surface; coupling the second planar sheet rear surface with the first planar sheet front surface by way of walls forming at least one primary compartment therebetween for facilitating disposition of at least one informational item and at least one related kern, and coupling the third planar sheet rear surface with the second planar sheet front surface by way of wails forming at least one secondary compartment therebetween for facilitating disposition of at least one informational item and at least one related item; disposing an indicia element proximal to at least one of the at least one primary compartment and the at least one secondary compartment; disposing the at least one informational item and the at least one related item in at least one of the at least one primary compartment and the at least one secondary compartment; disposing the caddy system in relation to an object surface; and performing at least one of viewing, reading, and accessing at least one of the at least one informational item and the at least one related item.

Advantages of the various embodiments of the present disclosure include, but are not limited to, providing easily accessible storage of blood lab order sheets and related items, payment books, providing holding and easy accessibility of frequently misplaced objects, providing easy attachability to a vertical surface, such as a refrigerator door, cabinet door, bulletin board, or any other vertical space. These advantages, other objectives, and benefits as described herein will become apparent from the following description taken in conjunction with the accompanying drawings wherein and set forth, by way of illustration and example, certain embodiments of the invention. The drawings are intended to constitute a part of this specification and include exemplary embodiments of the present disclosure and illustrate various objects and features thereof.

BRIEF DESCRIPTION OF THE DRAWING

The above, and other, aspects, features, and advantages of several embodiments of the present disclosure will be more apparent from the following Detailed Description as presented in conjunction with the following several figures of the Drawing.

FIG. 10 is a schematic diagram illustrating a frontal perspective view of an attachable organizer-caddy system, in accordance with an embodiment of the present disclosure.

FIG, 11 is a schematic diagram illustrating a front view of an attachable organizer-caddy system, in accordance with an embodiment of the present disclosure.

FIG. 12 is a schematic diagram illustrating a side perspective view of an attachable organizer-caddy system, in accordance with an embodiment of the present disclosure.

FIG. 13 is a schematic diagram illustrating a side view of an attachable organizer-caddy system, in accordance with an embodiment of the present disclosure.

FIG. 14 is a schematic diagram illustrating a rearward perspective view of an attachable organizer-caddy system, in accordance with an embodiment of the present disclosure.

FIG. 15 is a schematic diagram illustrating a top view of an attachable organizer-caddy system, in accordance with an embodiment of the present disclosure.

Figure 16:
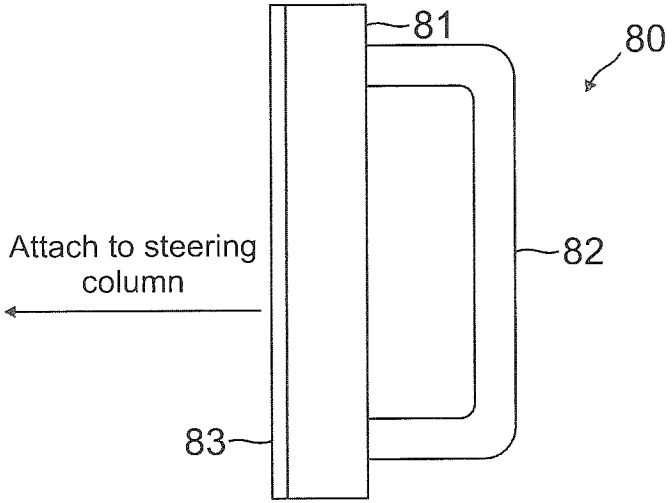

FIG. 16 is a schematic diagram illustrating a top view of an auxiliary accessory holder that is includable with an attachable organizer-caddy system, in accordance with an embodiment of the present disclosure.

Figure 17:
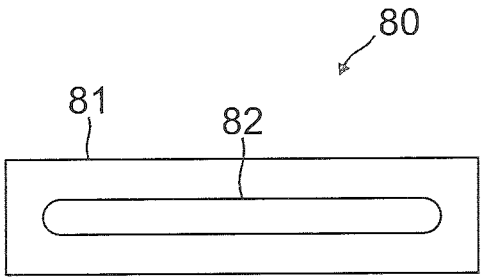

FIG. 17 is a schematic diagram illustrating a front view of an auxiliary accessory holder, as shown in FIG. 16, that is includable with an attachable organizer-caddy system, in accordance with ail embodiment of the present disclosure.

Corresponding reference characters indicate corresponding components throughout the several figures of the Drawing. Elements in the several figures are illustrated for simplicity and clarity and have not necessarily been drawn to scale. For examples the dimensions of some of the elements in the figures may be emphasized relative to other elements for facilitating understanding of the various presently disclosed embodiments. Also, common, but well -understood, elements that are useful or necessary in commercially feasible embodiment are often not depicted in order to facilitate a less obstructed view of these various embodiments of the present disclosure.

DETAILED DESCRIPTION

The following description is not to be taken in a limiting sense, but is made merely for the purpose of describing the general principles of exemplary embodiments. The scope of the disclosure should be determined with reference to the Claims. Reference throughout this specification to "one embodiment," "an embodiment," or similar language means that a particular feature, structure, or characteristic that is described in connection with the embodiment is included in at least one embodiment of the present disclosure. Thus, appearances of the phrases "in one embodiment," "in an embodiment," and similar language throughout this specification may, but do not necessarily, all refer to the same embodiment.

Further, the described features, structures, or characteristics of the present disclosure may be combined in any suitable manner in one or more embodiments. In the Detailed Description, numerous specific details are provided for a thorough understanding of embodiments of the disclosure. One skilled in the relevant art will recognize, however, that the embodiments of the present disclosure can be practiced without one or more of the specific details, or with other methods, components, materials, and so forth. In other instances, well -known structures, materials, or operations are not shown or described in detail to avoid obscuring aspects of the present disclosure.

Figure 1:
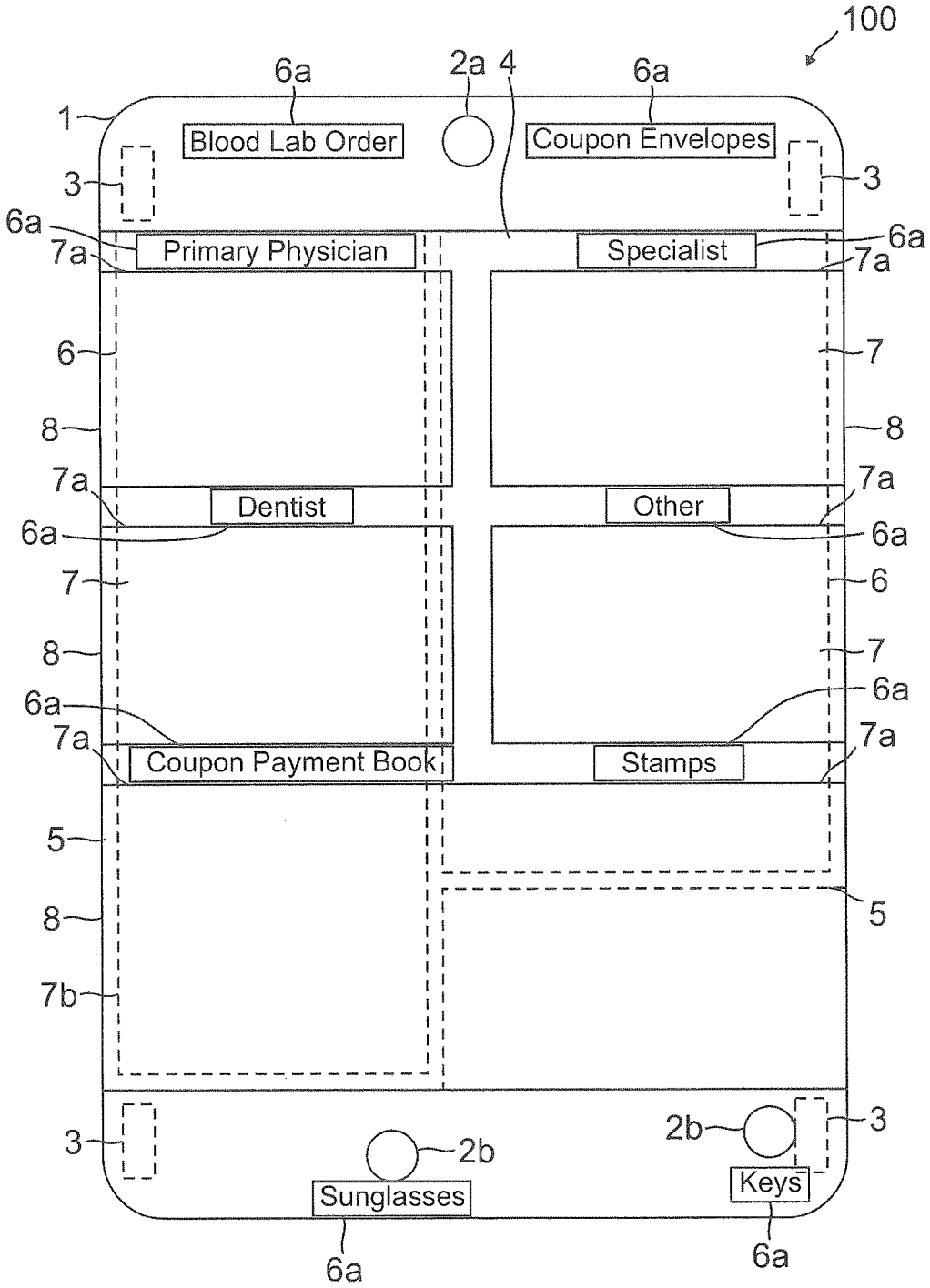
FIG. 1 is a schematic diagram illustrating a front view of an attachable organizer-caddy system, in accordance with an embodiment of the present disclosure.

Referring to FIG. 1, this schematic diagram illustrates a front view of an attachable organizer-caddy system 100, in accordance with an embodiment of the present disclosure. The attachable organizer-caddy system generally comprises: a first planar sheet 1 having a front surface and a rear surface (not shown); and a second planar sheet 4 having a front surface and a rear surface (not shown), the second planar sheet rear surface capable of coupling with the first planar sheet front surface by -way of at least one wall 5 with an adhesive feature, such as a double-stick feature and a permanent adhesive, and forming at least one primary compartment 6 (FIG. 2) therebetween for facilitating disposition of at least one informational item, such as at least one blood lab order sheet, and related items, such as at least one coupon envelope.

Still referring to FIG. 1, the first and second planar sheets 1, 4, each further comprise at least one material, such as a rigid material, a flexible material, and a semi-rigid material. The first planar sheet 1 further comprises at least one of at least one primary magnet 2*a* capable of coupling with a magnetic surface, such as a steel refrigerator door, and at least one adhesive strip 3 capable of coupling with a non-magnetic or tow-magnetic surface, such as a cabinet door, an austenitic stainless steel refrigerator door, a bulletin board, and the like; and at least one secondary magnet 2*b* disposed in relation to the first planar sheet front surface, such as by embedding therein or thereon, for facilitating quick detachable coupling of magnetic and magnetically adaptable items. The at least one primary magnet 2*a* is embeddable in the first planar sheet 1. Alternatively, the at least one adhesive strip 3 is disposable in relation to the first planar sheet rear surface and further comprises a release ply or a removable backing (not shown) for facilitating deployment of the system 100 for ready attachment to either a magnetic surface, such as a steel refrigerator door, or a non-magnetic or low-magnetic surface, such as a cabinet door, an austenitic stainless steel refrigerator door, a bulletin board, and the like. The front side of each at least one secondary magnet 2*b* serves as a holding structure for magnetic and magnetically adaptable items.

Still referring to FIG, 1, the second planar sheet 4 further comprises at least one secondary compartment 7 disposed in relation to the second planar sheet front surface, the at least one .secondary compartment 7 comprising at least one size corresponding to, accommodating, and facilitating display of, at least one informational item (not shown) and at least one related item (not shown), such as at least one appointment card, at least one business card, and at least one coupon payment book, e.g., for the American Association of Retired Persons (AARP) discounts and transactions. Medicare related items, and Medicaid related items. The at least one secondary compartment 7 comprises an opening (not shown), e.g., laterally disposed, for facilitating insertion and removal of the at least one informational item and the at least one related item; and the at least one secondary compartment 7 comprises at least one of an optically transparent material and an optically translucent material.

Still referring to FIG. 1, the at least one secondary compartment 7 further comprises a window 7*a* having an optional magnifying feature 9 (FIG. 3) for facilitating viewing and/or reading of the at least one informational item and the at least one related item, e.g., without the use of prescription eyeglasses, reading glasses, or hand-held magnifying glasses. The optional magnifying feature 9 is further removable and/or customizable in relation to the optometric needs of a user. The wall 5 further comprises a thickness t, and lateral portions 5*a*, and at least one depression 5*b* disposed in relation to the lateral portions 5*a* and corresponding to each at least one secondary compartment 7 for facilitating manual disposition, e.g., insertion and removal of the at least one informational item and the at least one related item. The at least one window 7*a* comprises at least one of an optically transparent polymeric material and an optically translucent polymeric material. The at least one window 7*a* further comprises at least one of a polarizing filter material, a photochromic material, and a progressive lens material. Alternatively, the optional magnifying feature 9 comprises a Fresnel lens that is disposable either inside or outside the compartments. The optional magnifying feature 9 may comprise at least one of a Hat configuration and a curved configuration, such as a convex surface.

Still referring to FIG, 1, the at least one secondary compartment 7 further comprises a larger compartment 7*b* having a slot opening 8 disposed at both ends for facilitating disposition of the coupon book (not shown) as well as a flat took of stamps, e.g., postage stamps, trading stamps, food stamps (not shown), wherein a portion of the flat book of stamps is capable of sliding under a portion of the coupon book, whereby a sufficient portion of the flat book of stamps is visibly displayable. The system 100 further comprises a plurality of labels 6*a* for indicating the content of the at least one compartment 7, wherein the plurality of labels 6*a* comprise an adhesive and release ply.

Figure 2:
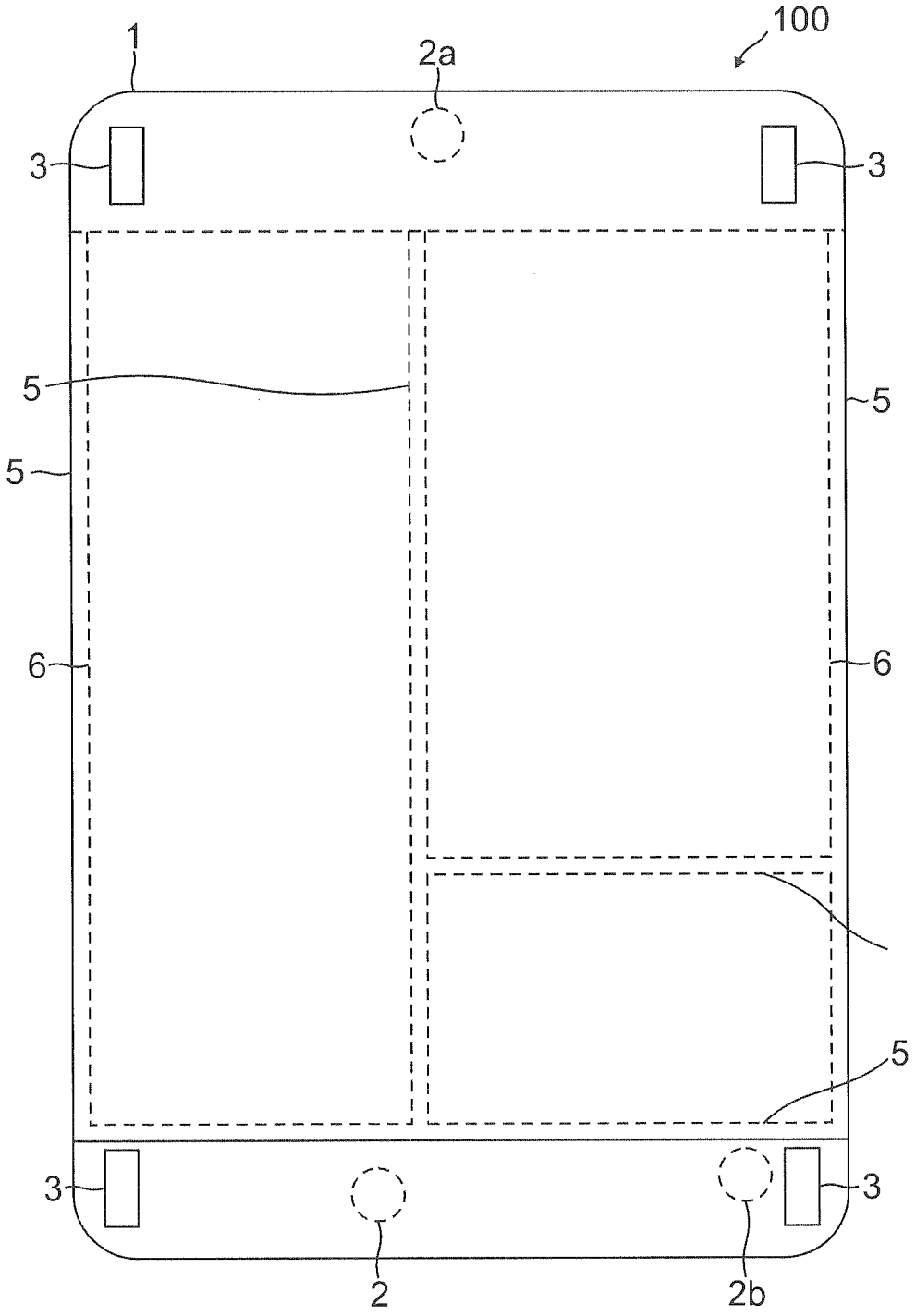
FIG. 2 is a schematic diagram illustrating a rear view of the attachable organizer-caddy system of FIG. 1, in accordance with an embodiment of the present disclosure.

Referring to FIG. 2, this schematic diagram illustrates a rear view of an attachable organizer-caddy system 100 of FIG. 1, in accordance with an embodiment of the present disclosure. The attachable organizer-caddy system 100 generally comprises: a first planar sheet 1 having a front surface and a rear surface (not shown); and a second planar sheet 4 having a front surface and a rear surface (not shown), the second planar sheet rear surface capable of coupling with the first planar sheet front surface by way at least one wall 5 with a double-Stick feature, and whereby at least one primary compartment 6 (FIG. 2) is provided therebetween for facilitating disposition of informational items and related items, such as at least one blood lab order sheet and at least one coupon envelope.

Figure 3:
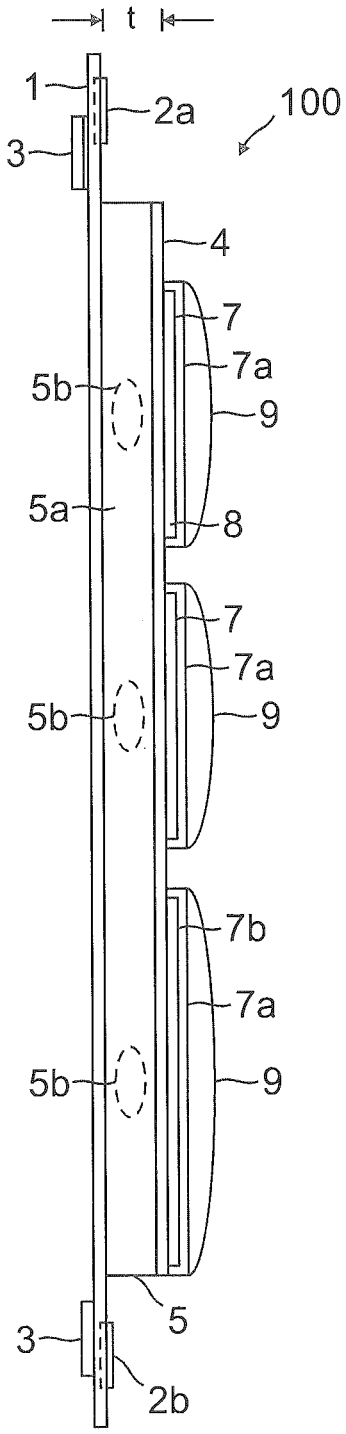
FIG. 3 is a schematic diagram illustrating a side, view of the attachable organizer-caddy system of FIG. 1, in accordance with an embodiment of the present disclosure.

Referring to FIG. 3, this schematic diagram illustrates a left side view of an attachable organizer-caddy system 100 of FIG. 1. in accordance with an embodiment of the present disclosure. The at least one secondary compartment 7 further comprises a window 7*a* having an optional magnifying feature 9 (FIG. 3) for facilitating viewing and/or reading the at least one informational item and the at least one related item. The optional magnifying feature 9 is further removable and/or customizable in relation to the optometric needs of a user. The wall 5 further comprises a thickness t, and lateral portions 5*a*, and at least one depression 5*b* disposed in relation to the lateral portions 5*a* and corresponding to each at least one secondary compartment 7 for facilitating manual disposition, e.g., insertion and removal, of the at least one informational item and the at least one related item. The at least one window 7*a* comprises at least one of an optically transparent polymeric material and an optically translucent polymeric material. The at least one window 7*a* further comprises at least one of a polarizing filter material, a photochromic material, and a progressive lens material. The magnifying feature 9 comprises a convex lens structure and is disposed on the window 7*a* for facilitating view and reading the content disposed in the secondary compartment 7. Alternatively, the optional magnifying feature 9 comprises a Fresnel lens that is disposable either inside or outside the compartments. The optional magnifying feature 9 may comprise at least one of a flat configuration and a curved configuration, such as a convex surface.

Referring to FIG, 4, this schematic diagram illustrates a front view of an attachable mounting device 15. e.g., in a kit, for facilitating in-vehicle operation of a system 100, in accordance with an embodiment of the present disclosure. The attachable mounting device 15 comprises a rigid planar strip 12 with an adhesive backing 11 for attaching the mounting device 12 to a part of the vehicle (not shown) and at least one quaternary magnet 2*d*, comprising a ferrous disc for example, for complementary coupling with the at least one primary magnet 2*a*. The at least one quaternary magnet 2*d* is embeddable in relation to the rigid planar strip 12. The kit further comprises a plurality of magnets for use as primary magnets 2*a*, secondary magnets 2*b*, tertiary magnets 2*c*, and quaternary magnets 2*d*, depending on the particular functionality desired by the user.

Figure 4:
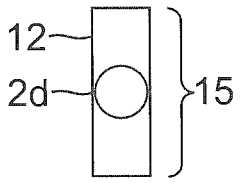
FIG. 4 is a schematic diagram illustrating a front view of an attachable mounting device for facilitating in-vehicle operation of the system as shown in FIG. 1, in accordance with an embodiment, of die present disclosure.

Still referring to FIG. 4, the attachable mounting device 15 further comprises a gimbaling feature (not shown) for facilitating angular disposition of the quaternary magnet 2*d* in relation to the rigid planar strip 12, thereby providing an optimal line of sight for the user while accommodating a variety of vehicle dashboard and console shapes. Alternatively, the device 15 is capable of accommodating a single magnetic object or a single magnetically adaptable object, such as sunglasses, by way of the magnet 2*c* detachably coupling with the magnet 2*d*. In lieu of the adhesive backing 11, the device 15 comprises a hook and loop fastener capable of coupling with a part of the vehicle, such as a sun visor, by way of at least one corresponding hook and loop fastener (not shown), wherein the at least, one corresponding hook and loop fastener is disposed on a band (not shown). The band comprises an elastic material disposable around the sun visor such: that the user may adjust the disposition of the at least one corresponding hook and loop fastener.

Referring to FIG, 5, this schematic diagram illustrates a rear view of an attachable mounting device 15 of FIG. 4 for facilitating in-vehicle use of a system 100 in a kit, in accordance with an embodiment of (he present disclosure. The attachable mounting device 15 comprises a rigid planar strip 12 with an adhesive backing 11 for attaching the mounting device 12 to a part of the vehicle (not shown; and at least one quaternary magnet 2*d*, comprising a ferrous disc for example, for complementary coupling with the at least one primary magnet 2*a*. The at least one quaternary magnet 2*d* is embeddable in relation to the rigid planar strip 12. The kit further comprises a plurality of magnets for use as primary magnets 2*a*, secondary magnets 2*b*, tertiary magnets 2*c*, and quaternary magnets 2*d*, depending on the particular functionality desired by the user.

Figure 5:
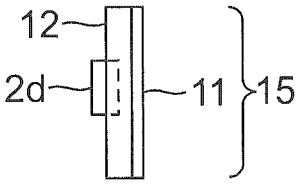
FIG. 5 is a schematic diagram illustrating a side view of the attachable mounting device of FIG. 4 for facilitating in-vehicle operation of the system as shown in FIG. 1, in accordance with an embodiment of the present disclosure.

Still referring to FIG. 5, the attachable mounting device 15 further comprises a gimbaling feature (not shown) for facilitating angular disposition of the quaternary magnet 2*d* in relation to the rigid planar strip 12, thereby providing an optimal line of sight for the user while accommodating a variety of vehicle dashboard, console, and sun visor shapes. The mounting device 15 may be coupled with a part of a motor vehicle (not shown) for ready deployment when the system 100 or even the frequently misplaced item itself, such as sunglasses, is needed while on travel With respect to in-vehicle operation, the compartments 6 and 7 of the system 100 may also accommodate informational items relating to addresses, telephone numbers, itineraries, including connecting travel tickets (airline tickles, train tickets, ferry tickets, cruise tickets), lodging reservations, restaurant reservations, and the like. Such informational items may supplement information that is available via a global positioning system or be made more assessable for seniors.

Figure 6:
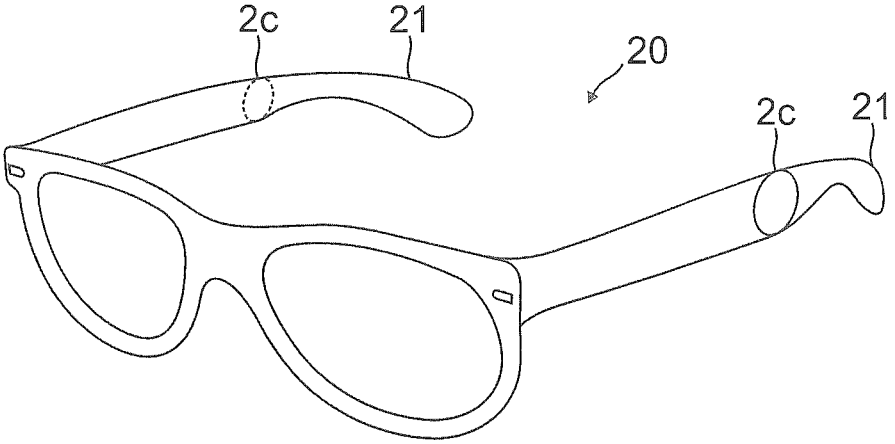
FIG. 6 is a schematic diagram illustrating a perspective view of a nonmagnetic item in an open position being magnetically adapted by at least one tertiary magnet, provided in a kit, for operation with the system of FIG. 1, in accordance with an embodiment of the present disclosure.

Referring to FIG. 6, this schematic diagram illustrates a perspective view of a nonmagnetic item 20 in an open position, such as nonmetallic sunglasses, having a pair of tertiary magnets 2*c*, e.g., in a kit, disposed proximate to the earpieces 21, by example only, with an adhesive backing (not shown) for magnetically adapting the nonmagnetic item 20 for magnetic attachment to the corresponding secondary magnet 2*b*, in accordance with an embodiment of the present disclosure. Alternatively, in lieu of magnets 2*c*, 2*d*, the kit may include at least one hook and loop fastener (not shown) capable of coupling the nonmagnetic item 20 with a part of the vehicle, such as a sun visor, by way of at least one corresponding hook and loop fastener (not shown), wherein the at least one corresponding hook and loop fastener is disposed on a band (not shown). The band comprises an elastic material disposable around the sun visor such that the user may adjust the disposition of the at least one corresponding hook and loop fastener.

Figure 7:
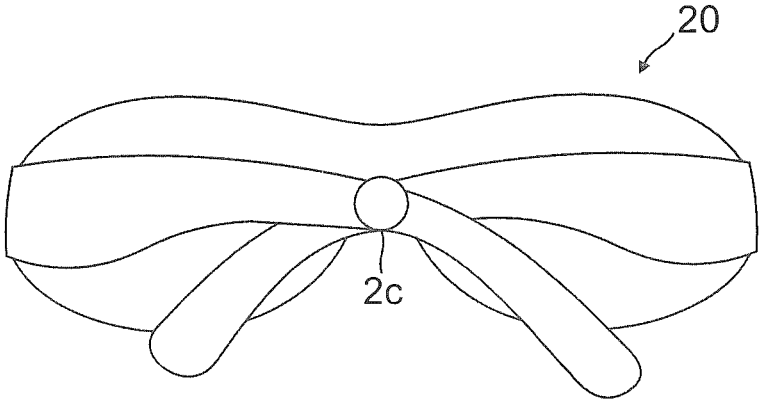
FIG. 7 is a schematic diagram illustrating a rear view of the nonmagnetic item of FIG. 6, in a closed position, being magnetically adapted by at least one tertiary magnet, provided in a kit, for operation with the system of FIG. 1, in accordance with an embodiment of the present disclosure.

Referring to FIG. 7, this schematic diagram illustrates a nonmagnetic item 20 of FIG. 6 in a closed position, such as nonmetallic sunglasses, having a pair of tertiary magnets 2*c*, e.g., in a kit, disposed proximate to the earpieces 21, by example only, with an adhesive backing (not shown) for magnetically adapting the nonmagnetic item 20 for magnetic attachment to the corresponding secondary magnet 2*b*, in accordance with an embodiment of the present disclosure. The kit further comprises instructions for aligning and applying tertiary magnets 2*c* to the nonmagnetic item 20.

Figure 8:
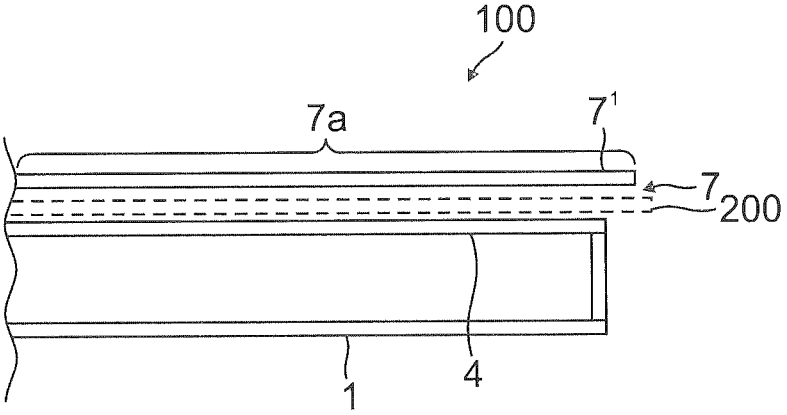
FIG. 8 is a schematic diagram illustrating a cut-away side view of a compartment of an attachable organizer-caddy system, having a card therein disposed, in accordance with an embodiment of the present disclosure.

Referring to FIG. 8, this schematic diagram illustrates, in a cut-away side view, a compartment 7 of an attachable organizer-caddy system 100, having a card 200 therein disposed, in accordance with an embodiment of the present disclosure. In alternative embodiments, the windows 7*a* are formed by a third planar sheet 7' disposed over the second planar sheet 4, wherein the third planar sheet 7' comprises at least one of an indentation (not shown) or a cut -away section (not shown) and an extension 7*e* for facilitating grasping of the card 200, such as a calling card, e.g., business card or an appointment card, by a user (not shown), wherein the card is extendible beyond the third planar sheet 7' as well as the second planar sheet 4. By example only, the card is extendible by approximately 3/16 inch beyond a span of the second planar sheet 4 and by approximately 1/16 inch beyond a span of the third planar sheet 7', whereby the card is visible though the third generally planar sheet 7'. Accordingly, the third planar sheet 7' extends beyond the second planar sheet 4 by approximately 2/16 inch.

Figure 9:
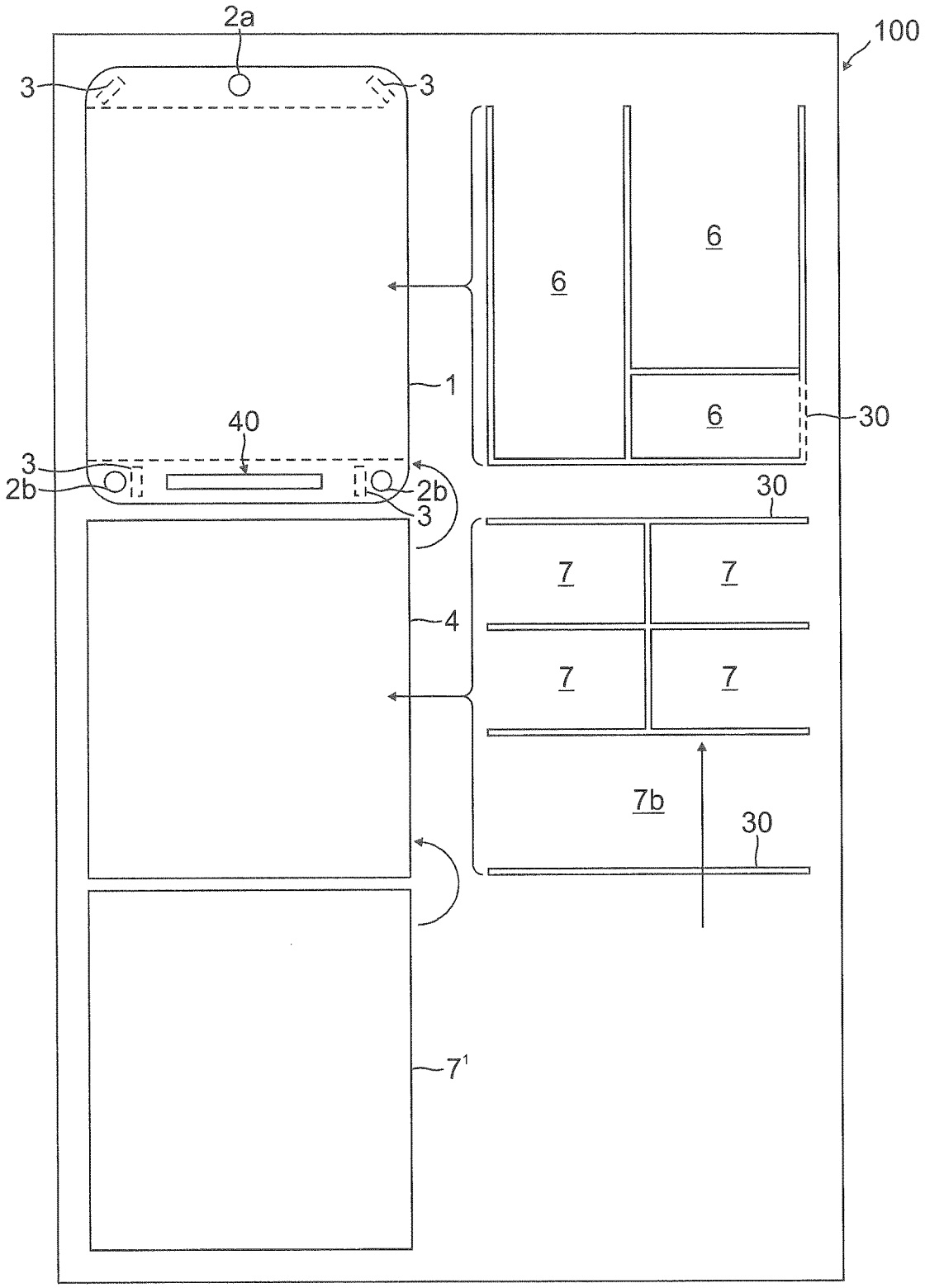
FIG. 9 is a schematic diagram illustrating an exploded front view of an attachable organizer-caddy system, comprising a plurality of generally planar sheets and partitions, in accordance with an embodiment of the. present disclosure.

Referring to FIG. 9, this schematic diagram illustrates, in an exploded from view, an attachable organizer-caddy system 100, comprising a plurality of generally planar sheets, such as the planar sheets 1, 4, and 7' and at least one wall 30, in accordance with an embodiment of the present disclosure. The attachable organizer-caddy system 100 generally comprises: a first planar sheet 1 having a front surface and a rear surface (not shown); a second planar sheet 4 having a font surface and a rear surface (not shown), and a third planar sheet 7'. The second planar sheet 4 rear surface is configured to couple with the first planar sheet 1 from surface by way of at least one wall 30, wherein the at least one wall 30, along with the first and second planar sheets 1, 4, is configured to provide at least one of at least one primary compartment 6 for accommodating at least one of at least one health laboratory work order sheet (not shown), such as a blood work order sheet, and at least one envelope (not shown) as well as at least one empty compartment 6' which may be optionally accessible, and wherein the at least one wall 30 comprises a depth of approximately ½ inch and a thickness of approximately 1/16 inch, by example only. The third planar sheet 7' rear surface is also configured to couple with the second planar sheet 4 front surface by way of at least one wall 30, wherein the wail 30 is configured to wherein the wall 30, along with the second and third planar sheets 4, 7', is configured to provide at least one secondary compartment 7 for accommodating at least one of at least one calling card (not shown) and at least one envelope (not shown), and wherein the wall 30 comprises a depth of approximately 3/16 inch for accommodating a plurality of calling cards in the at least one secondary compartment 7 and a thickness of approximately 1/16 inch, by example only.

Still referring to FIG. 9, the wall 30 is coupled to the respective planar sheets 1, 4, 7' by at least one technique, such as an adhesive, an adhesive strip, e.g., at least one wall 5, and integrally forming, e.g., by preferably molding, beating, pressing, or a combination thereof. The at least one wall 5 has an adhesive feature, such as a double-stick feature and a permanent adhesive, and forms at least one primary compartment 6 therebetween for facilitating disposition of at least one informational item, such as at least one blood lab order sheet, and related items, such as at least one coupon envelope. The planar sheet 1 further comprises a hook 40 being horizontally disposable for slidably accommodating hangable objects, such as eyewear, keys, small tools, small flashlights, and the like, in order to make them handy in relation to the user.

Still referring to FIG. 9, the first and second planar sheets 1, 4, each further comprise at least one material, such as a rigid material, a flexible material, and a semi-rigid material. The first planar sheet 1 further comprises at least one of at least one primary magnet 2*a* capable of coupling with a magnetic surface, such as a steel refrigerator door, and at least one adhesive strip 3 capable of coupling with a non-magnetic or low-magnetic surface, such as a cabinet door, an austenitic stainless steel refrigerator door, a bulletin board, and the like; and at least one secondary magnet 2*b* disposed in relation to the first planar sheet front surface, such as by embedding therein or thereon, for facilitating quick detachable coupling of magnetic and magnetically adaptable items. The at least one primary magnet 2*a* is embeddable in the first, planar sheet 1. Alternatively, at least one adhesive strip 3 is disposable in relation to the first planar sheet rear surface and further comprises a release ply or a removable backing (not shown) for facilitating deployment of the system 100 for ready attachment to either a magnetic surface, such as a steel refrigerator door, or a non-magnetic or low-magnetic surface, such as a cabinet door, an austenitic stainless steel refrigerator door, a bulletin board, and the like. The front side of each at least one secondary magnet 2*b* serves as a holding structure for magnetic and magnetically adaptable items.

Still referring to FIG. 9, the second planar sheet 4 further comprises at least one secondary compartment 7 disposed in relation to the second planar sheet front surface, the at least one secondary compartment 7 comprising at least one size corresponding to, accommodating, and facilitating display of, at least one informational item (not shown) and at least one related item (not shown), such as at least one appointment card, at least one business card, and at least one coupon payment book, e.g., for the American Association of Retired Persons (AARP) discounts and transactions, Medicare related items, and Medicaid related items. The at least one secondary compartment 7 comprises an opening (not shown), e.g., laterally disposed, for facilitating insertion and removal of the at least one informational item and the at least one related item; and the at least one secondary compartment 7 comprises at least one of an optically transparent material and an. optically translucent material.

Still referring to FIG. 9, in this alternative embodiment, the planar sheet 7' further comprises at least one window 7*a* having an optional magnifying feature 9 (See also FIG. 3.) for facilitating viewing and/or reading of the at least one informational item and the at least one related item, e.g., without the use of prescription eyeglasses, reading glasses, or hand-held magnifying glasses, that is disposed in the at least one secondary compartment 7. The optional magnifying feature 9 is further optionally removable and/or customizable in relation to the optometric needs of a user. At least one of the planar sheet 7' and the at least one window 7*a* comprises at least one of an optically transparent polymeric material and an optically translucent polymeric material. The at least one window 7*a* further comprises at least one of a polarizing filter material, a photochromic material, and a progressive lens material.

Still referring to FIG. 9, the at least one secondary compartment 7 further comprises a larger compartment 7*b* having a slot opening 8 disposed at both ends Tor facilitating disposition of the coupon book (not shown) as well as a flat book of stamps, e.g., postage stamps, trading stamps, food stamps (not shown), wherein a portion of the flat book of stamps is capable of sliding under a portion of the coupon book, whereby a sufficient portion of the flat book of stamps is visibly displayable. The system 100 further comprised a plurality of labels 6*a* for indicating the content of the at least one compartment 7, wherein the plurality of labels 6*a* comprise an adhesive and a release ply.

Referring to FIG. 10, this schematic diagram illustrates, in a frontal perspective view, an attachable organizer-caddy system 100, comprising a plurality of generally planar sheets, such as the planar sheets 1, 4, and 7' and at least one wall 30, in accordance with an embodiment of the present disclosure. The attachable organizer-caddy system 100 generally comprises: a first planar sheet 1 having a front surface and a rear surface (not shown); a second planar sheet 4 having a front surface and a rear surface (not shown); and a third planar sheet 7'.

Referring to FIG. 11, this schematic diagram illustrates, in a front view, an attachable organizer-caddy system 100, comprising a plurality of generally planar sheets, such as the planar sheets 1, 4, and 7' and at least one wall 30, in accordance with an embodiment of the present disclosure. The attachable organizer-caddy system 100 generally comprises; a first planar sheet 1 having a front surface and a rear surface (not shown); a second planar sheet 4 having a front surface and a rear surface (not shown); and a third planar sheet 7'.

Referring to FIG. 12, this schematic diagram illustrates, in a side perspective view, an attachable organizer-caddy system 100, comprising a plurality of generally planar sheets, such as the planar sheets 1. 4, and 7' and at least one wall 30, in accordance with an embodiment of the present disclosure. The attachable, organizer-caddy system 100 generally comprises; a first planar sheet 1 having a front surface and a rear surface (not shown); a second planar sheet 4 having a front surface and a rear surface (not shown); and a third planar sheet 7'.

Referring to FIG, 13, this schematic diagram illustrates, in a side view, an attachable organizer-caddy system 100, comprising a plurality of generally planar sheets, such as the planar sheets 1, 4, and 7' and at least one wall 30, in accordance with an embodiment of the present disclosure. The attachable organizer-caddy system 100 generally comprises; a first planar sheet 1 having a front surface and a rear surface (not shown); a second planar sheet 4 having a front surface and a rear surface (not shown); and a third planar sheet 7'.

Referring to FIG. 14, this schematic diagram illustrates, in a rearward perspective view, an attachable organizer-caddy system 100. comprising a plurality of generally planar sheets, such as the planar sheets 1, 4, and 7' and at least one wall 30, in accordance with an embodiment of the present disclosure. The attachable organizer-caddy system 100 generally comprises: a first planar sheet 1 having a front surface and a rear surface (not shown); a second planar sheet 4 having a front surface and a rear surface (not shown); and a third planar sheet 7'.

Referring to FIG. 15, this schematic diagram illustrates, in a top view, an attachable organizer-caddy system 100, comprising a plurality of generally planar sheets, such as the planar sheets 1, 4, and 7' and at least one wall 30, in accordance with an embodiment of the present disclosure. The attachable organizer-caddy system 100 generally comprises: a first planar sheet 1 having a front surface and a rear surface (not shown); a second planar sheet 4 having a front surface and a rear surface (not shown); and a third planar sheet 7'.

Referring to FIG. 16, this schematic diagram illustrates, in a top view, an auxiliary accessory holder 80 that is includable with an attachable organizer-caddy system 100, auxiliary accessory holder 80 comprising a base potion 81, a holding portion 82 coupled with the base portion 81, and a coupling member 83 for coupling the base portion 81 to a surface, such as a surface of a vehicle's steering column by example only, in accordance with an embodiment of the present disclosure. The coupling member 83 comprises at least one of an adhesive, an adhesive tape, an adhesive foam, an adhesive strip, and a hook-and-loop fastener, the holding portion 82 is configured to accommodate objects, such as eyewear, keys, key chains, and any other object capable of being disposed in relation thereto.

Referring to FIG. 17, this schematic diagram illustrates, in a front view, an auxiliary accessory holder 80, as shown in FIG. 16, that is Includable with an attachable organizer-caddy system 100, auxiliary accessory holder 80 comprising a base portion 81, a holding portion 82 coupled with the base portion 85, and a coupling member 83 for coupling the base portion 81 to a surface, such as a surface of a vehicle's steering column by example only, in accordance with an embodiment of the present disclosure. The coupling member 83 comprises at least one of an adhesive, an adhesive tape, an adhesive foam, an adhesive strip, and a hook-and-loop fastener. the holding portion 82 is configured to accommodate objects, such as eyewear, keys, key chains, and any other object capable of being disposed in relation thereto.

Information as herein shown and described in detail is fully capable of attaining the above-described object of the present disclosure, the presently preferred embodiment of the present disclosure, and is, thus, representative of the subject matter which is broadly contemplated by the present disclosure. The scope of the present disclosure fully encompasses other embodiments which may become obvious to those skilled in the art, and is to be limited, accordingly, by nothing other than the appended claims, wherein any reference to an element being made in the singular is not intended to mean "one and only one" unless explicitly so stated, but rather "one or more." All structural and functional equivalents to the elements of the above-described preferred embodiment and additional embodiments as regarded by those of ordinary skill in the art are hereby expressly incorporated by reference and are intended to be encompassed by the present claims.

Moreover, no requirement exists for a system or method to address each and every problem sought to be resolved by the present disclosure, for such to be encompassed by the present claims- Furthermore, no element, component, or method step in the present disclosure is intended to be dedicated to the public regardless of whether the element, component, or method step is explicitly recited in the claims. However, that various changes and modifications in form, material, work-piece, and fabrication material detail may be made, without departing from the spirit and scope of the present disclosure, as set forth in the appended claims, as may be apparent to those of ordinary skill in the art, are also encompassed by the present disclosure,

The invention claimed is:

1. An attachable organizer-caddy system, the system comprising:

an organizer-caddy device having a top edge, a bottom edge and two side edges defining a generally rectangular profile, the device including a primary planar sheet, a secondary planar sheet, and a plurality of tertiary planar sheets;

the primary planar sheet is formed from a rigid material, forms a rear surface of the device and corresponds in shape to the rectangular profile;

the secondary planar sheet is formed from a rigid material and is spaced from the front surface of the primary planar sheet by a plurality of primary elongated walls which attach the secondary planar sheet to the front surface of the primary planar sheet;

the primary elongated walls, the primary sheet and the secondary sheet form a plurality of primary compartments open towards the top edge;

each of the tertiary planar sheets is spaced from the front surface of the secondary planar sheet by a plurality of secondary elongated walls which attach the tertiary planar sheets to the front surface of the secondary planar sheet;

the secondary elongated walls, the secondary sheet and the tertiary sheets form a plurality of secondary compartments with each tertiary sheet forming a separate secondary compartment open towards one of the side edges, at least two of the tertiary sheets spaced vertically from each other, wherein the primary planar sheet has a top edge, a bottom edge and two side edges, at least the top and bottom edges of the secondary planar sheet are vertically spaced from the respective top and bottom edges of the primary planar sheet.

2. The system of claim 1, wherein the tertiary sheets comprise at least one of a rigid material, a flexible material, and a semi-rigid material.

3. The system of claim 1, wherein the primary planar sheet further comprises: at least one adhesive strip capable of coupling with a non-magnetic surface.

4. The system of claim 1, wherein the primary planar sheet further comprises a magnet.

5. The system of claim 1, further comprising a magnifying feature selected from the group consisting of: a Fresnel lens, a removable magnifying feature, and a customizable magnifying feature.

6. The system of claim 1, further comprising an attachable mounting device comprising a mounting magnet for facilitating in-vehicle operation.

7. The system of claim 1, further comprising a depression disposed in the secondary planar sheet for facilitating insertion and removal of the at least one informational item and the at least one related item into and out of the secondary compartment.

8. The system of claim 1, wherein the primary planar sheet further comprises at least one hook horizontally disposed in relation to a lower portion of the primary planar sheet for slidably accommodating hangable objects.

* * * * *